United States Patent [19]

Raulins

[11] 3,937,279

[45] Feb. 10, 1976

[54] RETRACTABLE LANDING SHOULDER FOR DOWNHOLE DEVICES

[75] Inventor: George M. Raulins, Dallas, Tex.

[73] Assignee: Otis Engineering Corporation, Dallas, Tex.

[22] Filed: Dec. 23, 1974

[21] Appl. No.: 535,958

[52] U.S. Cl. ..... 166/214

[51] Int. Cl.[2] ..... E21B 23/00

[58] Field of Search ..... 166/214, 136

[56] References Cited

UNITED STATES PATENTS

| | | | |
|---|---|---|---|
| 1,193,769 | 8/1916 | Cushing | 166/136 |
| 2,447,546 | 8/1948 | Spencer | 166/136 |
| 2,606,616 | 8/1952 | Otis | 166/136 |

*Primary Examiner*—James A. Leppink
*Attorney, Agent, or Firm*—Warren H. Kintzinger

[57] ABSTRACT

A selective down-hole tool landing shoulder employing a housing with sliding internal sleeve member positionable between first and second detented positions within the housing. Resilient collet members, depending from the sleeve, carry radially inwardly extending bosses which define a full-bore opening with the sleeve in one position, and which are forced radially inwardly by camming action to define a restrictive bore as the sleeve is positioned to the second position.

11 Claims, 4 Drawing Figures

RETRACTABLE LANDING SHOULDER FOR DOWNHOLE DEVICES

Figure 1:
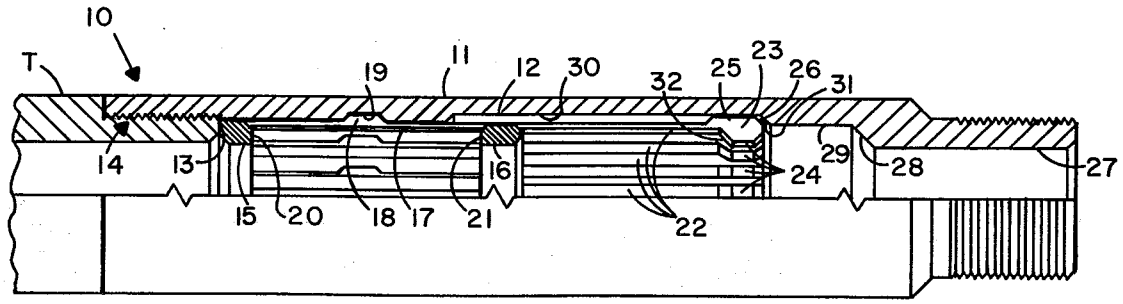

This invention relates in general to well tools, and in particular to a retractable landing shoulder for downhole devices.

While landing shoulder devices of fixed bore restriction are widely employed in tubing strings, these devices are not truly selective in nature. Selectivity, to a degree, may be realized by employing a number of landing nipples in predetermined sequential locations, with successive ones of the devices, as sequentially installed in a tubing string, having respective diminished stop bores for providing landing shoulders for respective different tools at predetermined locations in the string.

Quite often, in oil or gas wells, it becomes desirable to have at some point in the tubing string, a restriction so that various downhole flow controls can be run into the well and located by engagement of a shoulder with the restriction in the tubing string. Landing shoulders provide this restriction.

On the other hand, it is usually desirable, also, to have a tubing string with a full opening internal diameter that is without restriction, since a restriction may preclude the passage of certain larger tools downhole of the restricted location.

It is, therefore, a principle object of this invention to provide a truly selective landing shoulder device which may provide both of the above features, and to be selectively changeable to provide either a predetermined landing restriction or a full bore opening, as desired.

A further object is to provide such a selectively functional landing shoulder device which may be controlled by means of presently designed downhole positioning tools to alternatively provide one or the other of the full bore and restricted bore features above-described.

A still further object is to provide such a landing shoulder device which may be integrally combined with other downhole tools to provide a selectively obtainable bore restriction feature.

Features of this invention useful in accomplishing the above objects include, in a landing shoulder device, a housing containing a sliding internal sleeve member which, by means of an internal shoulder configuration, may be engaged by a positioning tool, and longitudinally positioned between first and second detented positions within the housing. The sleeve member carries depending resilient collet members, the end extremes of which carry radially inwardly-extending bosses. The inside of the housing is formed with successive inclined diameter transitions which provide a camming action on the collet-carried bosses to force them radially inwardly as the sleeve member is positioned from the full bore defining position to the restricted bore position. In the restricted bore position, the radially inward extremes of the bosses define a bore of smaller diameter than the full bore diameter.

Specific embodiments representing what are presently regarded as the best mode of carrying out the invention are illustrated in the accompanying drawings.

Figure 2:
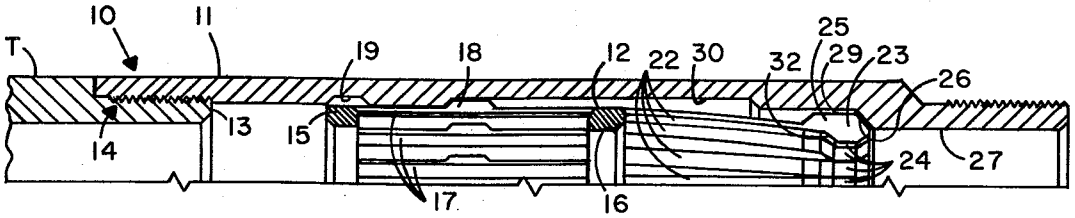
Figure 3:
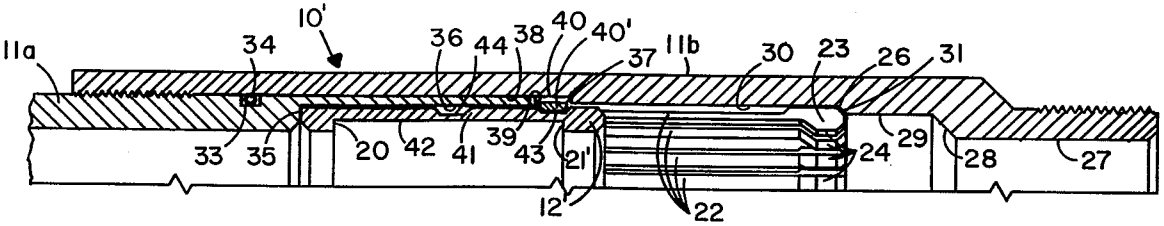
Figure 4:
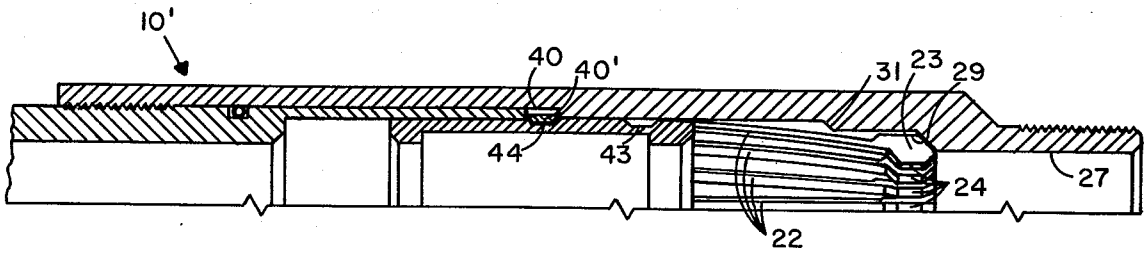

In the drawings:

FIG. 1 represents a side elevation cut away and sectioned view of a first embodiment of the invention with the sleeve member positioned to effect the full bore feature;

FIG. 2, a side elevation cut away and sectioned view of the embodiment of FIG. 1, with the sleeve member positioned to effect the restricted bore feature;

FIG. 3, a side elevation cut away and sectioned view of a second embodiment of the invention with the sleeve member positioned to effect the full bore feature; and FIG. 4, a side elevation cut away and sectioned view of the embodiment of FIG. 3 with the sleeve member positioned to effect the restricted bore feature.

Referring to the drawings:

The landing shoulder device 10 of FIG. 1 is shown in a landing nipple configuration where the device is provided with respective threaded ends for connection in a tubing run. As such, the device 10 comprises a nipple housing 11 which is threadedly connected in the tubing T. A sleeve member 12 is carried concentrically within the housing 11 for longitudinal sliding movement between upper and lower positions. Sleeve member 12 is depicted in the upper position in FIG. 1, with the upper end of sleeve 12 abutting the lower end 13 of tubing joint 14.

Sleeve member 12 comprises first and second space separated annular members 15 and 16 between which a plurality of resilient web members 17 extend. Each of the resilient web members 17 carries a radially outwardly extending boss 18. The bosses 18 are circumferentially disposed about the longitudinal axis of sleeve member 12, and, in the sleeve upper-position depicted in FIG. 1, are engaged in an annular recess 19 formed in the inner surface of housing 11, forming a detent tending to hold the sleeve member 12 in this upper position.

The sleeve annular members 15 and 16, between which detent bosses 18 resiliently depend, are formed with respective internal shoulders 20 and 21. A shifting tool, such as commercially available OTIS Shifting Tool 420072, may be uses to engage the upwardly facing shoulder 21 on annular member 16 to move the sleeve to its lower position. The same tool, mounted in reverse, may be used to engage the downwardly facing shoulder 20 on annular member 15 to move the sleeve from its lower position to the upper position depicted in FIG. 1.

A plurality of resilient collet finger members 22 depend longitudinally from sleeve annular member 16 with each finger carrying a boss 23 on the free end thereof. Bosses 23 comprises a radially inwardly extending portion 24 which communicates with a radially outwardly extending portion 25 via an inclined cam surface 26. The housing member 11 is formed with a lower end bore 27 corresponding to that of a tubing run in which the device is to be connected. Lower end bore 27 communicates via an internal annular stop shoulder 28 with an intermediate bore housing section 29, and intermediate bore section 29 communicates with a larger bore section 30 via housing internal bevel 31.

With the sleeve in the upper position depicted in FIG. 1, the radially outwardly extending portions 25 of the collet finger carried bosses 23 ride on the housing larger base section 30, such that the radially inwardly extending portions 24 of the bosses 23 defined a full-bore dimension equal that of the lower end bore 27 of housing 11. The inside diameter of sleeve annular members 15 and 16 likewise provide a full-bore opening, and the sleeve member does not restrict the tubing bore, since no part of it projects thereinto.

When the sleeve member 12 is positioned to the lower sleeve position depicted in FIG. 2, the radially outwardly extending bosses 18 on web members 17 cam out of their detented engagement in housing recess 19 against the restraint imposed by the resilient web members 17 and into engagement with the upper end larger diameter bore portion 30 of housing 11, with the cam surface 26 of collet bosses 23 co-acting with the housing internal bevel 31 to cause the fingers 22 to flex radially inwardly until the lower ends of bosses 23 contact the housing internal stop shoulder 28. The outer surfaces 25 of bosses 23 now ride on the housing intermediate bore section 29, with the radially inwardly extending extremes 24 of bosses 23 projecting into the tubing bore 27 to restrict the same and provide an internal annular upwardly facing shoulder 32 upon which tools or the like may be landed and supported.

When the sleeve member 12 is moved from the lower position depicted in FIG. 2 to the upper position depicted in FIG. 1, the collet fingers 22 inherently spring radially outwardly to cause the boss outer surfaces 25 to ride on housing larger bore section 30 such that the boss inner surfaces 24 no longer project into the tubing bore, with the sleeve bosses 18 flexing outwardly and into detented engagement with housing annular recess 19. Thus, the device is again full opening, i.e., it does not restrict the bore of the tubing run with which it is associated, and will allow full size tools to pass.

A further embodiment of the tool rest device 10' is depicted in FIGS. 3 and 4. As in the above described embodiment, a two-position sleeve member 12' is carried within a housing 11' . The sleeve member 12' carries longitudinally extending spring collet fingers 22, each carrying a boss 23 on the free end thereof. The bosses 23 of FIGS. 3 and 4 are like those of FIGS. 1 and 2 the lower portion of the housing again terminates in a bore 27 equal that of the tubing run with which the device is associated. Housing bore 27 again communicates via an internal annular stop shoulder 28 with a housing intermediate bore section 29, and intermediate bore section 29 communicates with a still larger housing bore section 30 via housing internal bevel 31. The camming action between collet bosses 23 and the housing internal bevel 31 again causes the boss inner extremes 24 to move radially inwardly as the sleeve is positioned from the upper sleeve position depicted in FIG. 3 to the lower sleeve position of FIG. 4, and thus to selectively restrict the tubing bore.

The embodiment of FIGS. 3 and 4 differs structurally from that of the embodiment of FIGS. 1 and 2 in the housing and sleeve configurations and the manner in which the sleeve is provided with detented upper and lower positions within the housing. Referring to FIG. 3, housing 11' is comprised of an upper housing section **11*a* and a lower section 11*b*. Each of the housing sections 11*a* and 11*b* is terminated in exampled external threads to facilitate interconnection in a tubing run. Housing section 11*a* is threadedly received in housing lower section 11*b*, with section 11*a* longitudinally extending concentrically within the lower section 11*b*. An annular recess 33 in section 11*a* provides a seat for O-ring 34 and thus establishes a sealed interconnection between housing sections 11*a* and 11*b*. The upper end bore of upper housing section 11*a* communicates via shoulder 35 to a larger bore section 36, corresponding to the larger bore section 30 of the lower housing section 11b. The larger bore section 30 of lower housing section 11*b* communicates via stop shoulder 37 with a still larger bore section 38 which corresponds to the outside diameter of the inserted extension of upper housing section 11*a*. The end 39 of the upper housing section is longitudinally spaced with respect to the lower section stop shoulder 37 to form the retaining recess 40 for a snap ring 40', with the latter, as will be further discussed, co-acting with the sleeve 12' to effect detented longitudinal positions of sleeve 12' within the housing assembly 11'**.

The upper part 41 of the sleeve 12' of FIG. 3 is formed as a hollow cylindrical member. An internal recess 42 in member 41 provides respective upward and downward facing stop shoulders 21' and 20' for engagement with the afore-described positioning tool for purposes of placing the sleeve 12' in a selected one of its upper and lower positions within housing 11'. Longitudinally displaced annular recesses 43 and 44 in cylinder member 41 co-act with snap ring 40' provide detented upper and lower positions of the sleeve within the housing. In the upper sleeve position of FIG. 3, the upper end of sleeve 12' rides on housing stop shoulder 35 with snap ring 40 engaging the annular recess 43 in the sleeve to provide position detent. In the lower sleeve position of FIG. 4, the snap ring 40' engages the annular recess 44 in the sleeve to provide a lower position detent for sleeve 12', with the collet finger bosses 23 projecting into and thus restricting the tubing bore 27.

It should be realized that those familiar with downhole, wireline-operable well tools might visualize variations of the device. For example, the same devices herein described might be equipped with other inner configurations for engaging other types of shifting tools. Similar configurations might be used to provide a landing nipple downhole that could be actuatable by a shifting tool, as referenced herein, or by a selected running tool. The device might be mounted on the inner sleeve of a sliding side door tool, such that, in either the opened or closed position of the sliding side door, a landing shoulder would be provided, or, alternatively, a landing shoulder be, or not be, provided in either position, as required.

Thus, whereas this invention is herein illustrated and described with respect to particular embodiments thereof, it should be realized that various changes may be made without departing from essential contributions to the art made by the teachings hereof.

I claim:

1. A selectively functionable downhole tool rest device comprising an annular housing means having a longitudinal bore therethrough for passage of fluids and tools, and inner sleeve member slideably received in said housing means; co-active detent means carried by said sleeve member and housing means and defining first and second resiliently detented longitudinal positions of said sleeve member within said housing means; a plurality of circumferentially disposed resilient collet finger members depending from an upper section of said sleeve member and extending longitudinally therefrom; a plurality of radially inward extending bosses carried individually on the respective free-end extremes of said collet members; said sleeve member having inside diameter defining extremes defining a bore equal that of the longitudinal end-extreme bore of said housing means with the radially inward extremes of said collet-carried bosses defining said housing means longitudinal extreme end bore with said sleeve member in a first detented longitudinal position; said housing means being formed with a bore transition with which camming surface means on the longitudinal end-extremes of said bosses engage to urge said bosses radially inwardly upon said sleeve member being positioned to said second detented longitudinal position at which the radially inward extremes of said bosses define a bore less than that of said housing longitudinal end-extreme bore.

2. The tool rest device of claim 1, wherein the inner wall of said housing means is formed with a first annular inclined-surface transition between a sleeve member outer diameter defined portion to a portion having a lessor bore intermediate than that of said sleeve member outer diameter and that of said housing means; said inner wall of said housing means being formed with a second annular inclinded-surface transition between said intermediate bore and that of said housing means; said collet-carried bosses being formed with an inclined end-extreme surface for camming engagement with said first housing bore transition upon said sleeve being shifted from said first detented longitudinal position to said second detented longitudinal position whereupon the radial outward extremes of said bosses ride on said intermediate bore portion of said housing.

3. The tool rest device of claim 2, wherein said sleeve member upper portion is formed with a pair of longitudinally displaced radially inwardly extending internal stop shoulders respective ones of which comprise a downhole facing shoulder and an uphole facing shoulder for respective co-acting positioning engagement with a downhole positioning tool for selective longitudinal positioning of said sleeve member to said first and second detented positions within said housing means.

4. The tool rest device of claim 3, wherein said housing means is formed with an annular internal stop shoulder against which the upper extreme of said sleeve member abutts with said sleeve member in said first detented longitudinal position within said housing means.

5. The tool rest device of claim 4, wherein the upper portion of said housing means is formed with a bore intermediate that of said housing longitudinal extreme bore and the larger bore section of said housing means defined by the outer diameter of said sleeve member, with a radially outwardly extending annular recess formed therein; said annular recess having respective oppositely inclined surface side walls; and said sleeve member carrying radially outwardly extending spring loaded bosses conformingly engageable with said housing annular recess with said sleeve member in said first longitudinal position thereof, and outer extremes of said bosses engaging said housing means larger bore portion with said sleeve member in said second longitudinal position thereof.

6. The tool rest device of claim 5, wherein said sleeve member upper section is formed of first and second space-separated annular members between which a plurality of longitudinally extending resilient web members depend; each of said web members carrying thereon one of said spring-loaded bosses; and with said resilient collet members depending from the lower one of said first and second annular members.

7. The tool device of claim 4, wherein said housing means larger bore portion is formed with a radially-outward, circumferentially extending recess therein; said sleeve member upper section comprising a hollow cylindrical member, the outer surface of which is formed with first and second longitudinally displaced annular recesses having inclined-surface side walls; and a resilient snap-ring confinably carried in said housing recess to effect a longitudinal position detent for daid sleeve member by being resiliently seated in respective ones of said cylinder member recesses, with said sleeve in said first and second longitudinal positions within said housing means.

8. The tool rest device of claim 7, wherein said snap-ring is formed with beveled inner edges to conform with the cross-section of said cylinder member annular recesses and effects, by camming action, expanding deformation of said snap-ring upon said sleeve member being moved between said first and second longitudinal positions thereof.

9. The tool rest device of claim 7, wherein said housing means is formed of an upper section and a lower section each with means on the extremes thereof for interconnection with a tubing string; means for threadedly interconnecting said housing upper and lower sections with one section extending longitudinally beyond the threaded interconnection and concentrically within the bore of the other section with the inserted end extreme thereof defining one wall of the recess into which said snap-ring is confinably received.

10. The tool rest device of claim 9, further comprising O-ring sealing means confined between the outer wall of the inner concentric one of said housing sections and the inner wall of the outer concentric one of said housing sections.

11. In a tubular housing threadedly connectable to a pipe string, internal shoulder means on resilient collet arm extensions from a sleeve member movable radially inwardly and outwardly between inward restrictive bore opening and outward full-bore opening positions; and collet arm extension shoulder positioning cam means in said tubular housing for camming said collet arm extensions between the radially outward and inward positions, using primarily straight longitudinal movement of the sleeve member, with the resilient collet arm extensions, through a camming range of movement.

* * * * *